US010533280B2

(12) United States Patent
Zeng et al.

(10) Patent No.: US 10,533,280 B2
(45) Date of Patent: Jan. 14, 2020

(54) SPECIAL-SHAPED CABLE CORE FORMING MECHANISM

(71) Applicant: Chongqing Yufeng Xinxin Wire & Cable Technology Co., Ltd., Chongqing (CN)

(72) Inventors: Lingguo Zeng, Chongqing (CN); Yongxin Yang, Chongqing (CN); Zhijun Li, Chongqing (CN); Tianyuan Li, Chongqing (CN); Zhouquan Yang, Chongqing (CN)

(73) Assignee: Chongqing Yufeng Xinxin Wire & Cable Technology Co. Ltd., Chongqing (CN)

( * ) Notice: Subject to any disclaimer, the term of this patent is extended or adjusted under 35 U.S.C. 154(b) by 177 days.

(21) Appl. No.: 15/800,597

(22) Filed: Nov. 1, 2017

(65) Prior Publication Data

US 2018/0340295 A1 Nov. 29, 2018

(30) Foreign Application Priority Data

May 27, 2017 (CN) ..... 2017 1 0392497

(51) Int. Cl.
*D07B 7/02* (2006.01)

(52) U.S. Cl.
CPC ..... *D07B 7/025* (2013.01)

(58) Field of Classification Search
CPC ..... D07B 7/025; D07B 1/147; D07B 3/00; D07B 2207/4018; D07B 2501/406; D07B 2207/4022; D01H 4/02; D01H 4/04
USPC ..... 57/311
See application file for complete search history.

(56) References Cited

U.S. PATENT DOCUMENTS

| | | | | |
|---|---|---|---|---|
| 2,124,864 A * | 7/1938 | Weller | D07B 7/025 57/9 |
| 2,277,134 A * | 3/1942 | Nelson | D07B 7/06 188/71.5 |
| 3,789,596 A * | 2/1974 | Richley | D07B 7/025 57/138 |
| 2005/0015978 A1* | 1/2005 | Andersen | D07B 7/025 29/868 |
| 2012/0291414 A1* | 11/2012 | Mackey | D07B 7/025 57/138 |
| 2018/0340295 A1* | 11/2018 | Zeng | D07B 1/147 |

FOREIGN PATENT DOCUMENTS

DE 699485 C * 11/1940 ..... D07B 7/025

* cited by examiner

*Primary Examiner* — Shaun R Hurley
*Assistant Examiner* — Patrick J. Lynch
(74) *Attorney, Agent, or Firm* — Inskeep IP Group, Inc.

(57) ABSTRACT

A layer of wires is preliminarily stranded by a layer of strand-through holes, and a first strand cylinder is used for the second pressing and stranding. The next layer of special-shaped single wires is stranded through a second pre-stranding assembly, and then the last layer of wires is stranded through a main stranding mold, thus stranding a plurality of layers at the same time with a compact structure. The outer circumference of the guide roller matches that of the special-shaped single wire, avoiding the reduced quality of stranded cable core. The first rotating connector is bowl-shaped and is provided with a layer of strand-through holes together with a structure in which a first pull rod is in fit with the rotating connector and a structure in which a second pull rod is in fit with the rotating connector.

10 Claims, 5 Drawing Sheets

SPECIAL-SHAPED CABLE CORE FORMING MECHANISM

RELATED APPLICATIONS

This application claims priority to Chinese Patent Application No. 201710392497.X, filed May 27, 2017, entitled Special-shaped Cable Core Forming Mechanism, which is incorporated herein by reference in its entirety.

FIELD OF THE INVENTION

The present invention relates to the manufacturing field of special-shaped cable cores, in particular to a special-shaped cable core forming mechanism.

DESCRIPTION OF THE RELATED ART

With the advancement of the processing technology for wires and cables, overhead wires and power cable conductors begin to develop toward the molded stranded wire structure. A molded stranded conductor is characterized by small outer diameter and smooth appearance. Application of molded wire stranding in the overhead wires has the characteristics of slow icing, reduced wind load and improved resistance to high-voltage corona.

The application of molded wire stranding in the power cable conductor is characterized by reduced cable breakdown rate, saved insulation and sheathing materials, increased fill factor of conductor as well as good radial and longitudinal waterproof characteristics. The cables widely applying the molded wire structure comprise aluminum alloy cable, medium and high voltage submarine cables and overhead insulated cable.

The conventional multi-core stranded cable is that the stranding direction of each single wire layer is opposite to that of the previous layer, and the outermost layer is generally stranded leftward. As the conventional single core is cylindrical, positive and negative alternation can increase the strength of cable cores. Meanwhile, the positive and negative alternation is still used in the process of stranding special-shaped cable cores in the prior art. If only one layer of cores is stranded, there is no difference from the conventional production process, and the time consumption is almost the same. It is only required to change the wire-drawing mold into the mold corresponding to the special-shaped wire. However, if there are two or more layers (generally, special-shaped wires have single layer, double layers or three layers), when the original mechanism and the raw material production method are still used for producing two or three layers of stranded special-shaped cable cores, two stranding steps are required to realize such purpose, which increases the processing time.

SUMMARY OF THE INVENTION

The present invention is provided for the problem that the existing cable core forming device can be only used to strand a layer of single wires at one time, one-time stranding is impossible when the wires are in multi-layer structure, and the stranded cable cores are not tight enough. In particular to a special-shaped cable core, a mechanism for stranding a plurality of cable cores at one time is provided, and the pre-stranding design enables the cable cores to strand layer by layer, which increases the tightness of the cable cores. Meanwhile, when the special-shaped cable cores are guided, the cross section is not easy to deform, thereby further ensuring tightness of the cable cores. The specific technical solution is as follows:

A special-shaped cable core forming mechanism comprises a guide assembly, a first pre-stranding assembly and a main stranding mold which are arranged successively at a same horizontal axis;

wherein the first pre-stranding assembly comprises a first tapered support, a first rotating connector, a first pull rod and a first strand cylinder; the horizontal axis passes through the first tapered support, the first rotating connector and the first strand cylinder in order, and the first pull rod is connected with the first rotating connector and the first strand cylinder;

the first tapered support is hollow and has two communicated end faces, and a large-diameter end of the first tapered support is fixed to the guide assembly;

the first rotating connector is bowl-shaped, and a bowl end of the first rotating connector is fixedly connected with a small-diameter end of the first tapered support; a stranded through hole layer is provided at the center of a bowl bottom of the first rotating connector, and the stranded through hole layer is collinear with the horizontal axis; a first annular groove is arranged at an inner side of the bowl bottom of the first rotating connector; a first annular hollow is arranged at the bowl bottom of the first rotating connector, and the first annular hollow corresponds to the first annular groove; and a first seizing ball is arranged on one end of the first pull rod, and the first seizing ball and the first annular groove are in sliding fit; one end, on which the first seizing ball is arranged, of the first pull rod movably passes through the first annular hollow, and the other end of the first pull rod is fixedly connected with the first strand cylinder.

The utility model is realized as follows: a special-shaped single wire passes through the guide assembly and is guided by the guide assembly into the first pre-stranding assembly for preliminary stranding, and then passes through the main stranding mold for stranding on the last layer and the final tightening of the whole cross section. When the special-shaped single wire passes through the guide assembly, the special-shaped single wire passes through the first tampered support along the horizontal axis, then passes through the stranded through hole layer and the first strand cylinder; and then the first tapered support rotates with the guide assembly, and the rotating connector rotates also. However, the first strand cylinder does not rotate due to the structure of the first annular hollow. When the special-shaped single wire passes through the stranded through hole layer, the wire is preliminarily stranded on the support conductor. When the special-shaped single wire passes through the first strand cylinder, the wire is further tightened and stranded. The special-shaped single wire is stranded on the support conductor to form a layer of stranded cable cores. Two stranding steps increase the tightness of the stranded cable cores.

As further defined, the special-shaped cable core forming mechanism also comprises a second pre-stranding assembly, wherein the second pre-stranding assembly comprises a second tapered support, a second rotating connector, a second pull rod and a second strand cylinder; the horizontal axis passes through the second tapered support, the second rotating connector and the second strand cylinder successively, and the second pull rod is connected with the second rotating connector and the second strand cylinder;

the second tapered support is hollow and has two communicated end faces, and a large-diameter end of the second tapered support is fixed to the guide assembly; the second tapered support is sheathed on the first tapered support, and there is a gap between the first tapered support and the second tapered support;

the second rotating connector is tubular, and has two communicated end faces; one end of the second rotating connector is fixedly connected with a small-diameter end of the second tapered support, and the other end of the second rotating connector is provided with a curl part; the curl part is collinear with the second rotating connector, and a second annular hollow is arranged on the curl part;

a second seizing ball wrapped by the curl part is arranged on one end of the second pull rod, and the second seizing ball and curl part are in sliding fit; one end, on which the second seizing ball is arranged, of the second pull rod movably passes through the second annular hollow, and the other end of the second pull rod is fixedly connected with the second strand cylinder; and the second strand cylinder is sheathed on the first strand cylinder, and there is a gap between the first strand cylinder and the second strand cylinder.

A layer of stranded cores pass through the second strand cylinder, so that two layers of special-shaped single wires are stranded on a layer of stranded cable cores; the two layers of special-shaped single wires are guided by the guide assembly to pass through the gap between the first tapered support and the second tapered support, then pass through the gap between the first strand cylinder and the second strand cylinder, and finally enter the second strand cylinder to joint with the orderly stranded cable cores, thus forming two layers of stranded cable cores.

As further defined, an inner hole of the first strand cylinder is tapered, a large-diameter end of the inner hole of the first strand cylinder is an incoming end, and a small-diameter end of the inner hole of the first strand cylinder is an outgoing end.

As further defined, an inner hole of the second strand cylinder is tapered, a large-diameter end of the inner hole of the second strand cylinder is an incoming end, and a small-diameter end of the inner hole of the second strand cylinder is an outgoing end.

The tapered hole enables the stranded special-shaped single wire to be extruded gradually.

As further defined, guide rollers are arranged on the small-diameter end of the inner hole of the first tapered support, and the number of the guide rollers is consistent with that of single wires on the same strand layer.

As further defined, guide rollers are arranged on the small-diameter end of the inner hole of the second tapered support, and the number of the guide rollers is consistent with that of single wires on the same strand layer.

The single wire is further guided, thus avoiding the single wire from being scratched.

As further defined, the guide assembly comprises a drum and a turntable; both ends of the drum are communicated, and the turntable is fixedly sheathed on the drum; both the first tapered support and the second tapered support are fixed to the turntable, and receiving through holes are arranged on the turntable in a manner of annular array; the receiving through holes pass through two end faces of the turntable; the number of the receiving through holes on the same annular array is consistent with that of the single wires on the same strand layer, and the number of the annular arrays of the receiving through holes is consistent with that of stranded cable core layers; and guide rollers are arranged in the receiving through holes respectively, and an outer circumference of the guide roller matches with an outer circumference of the single wire.

The drum drives the turntable to rotate synchronously, and each of the single wires passes through the receiving through holes, and is guided by the guide roller to rotate with the turntable. An outer circumference of the guide roller matches with an outer circumference of the single wire, so that the cross section shape of the special-shaped wire will not deform due to stress concentration when the guide roller guides the special-shaped single wire, thus avoiding the insufficiently tight stranding caused by the deformation during guide.

As further defined, the number of the turntables is three, and the three turntables are strung by the drum into one; the turntable comprises a first turntable, a second turntable and a third turntable in order; both the first tapered support and the second tapered support are fixed to the third turntable; each of the single wires passes through the first turntable, the second turntable, and the third turntable in order, and each of the single wires offsets toward the drum at the second turntable.

The single wire passes through the first turntable, second turntable and third turntable in order.

As further defined, a wire entry of the stranded through hole layer is flared.

The single wire is protected from damage, so that the single wire can be pressed and stranded gradually.

As further defined, the first rotating connector and the first tapered support are fixedly connected in a detachable manner, and the second rotating connector and the second tapered support are fixedly connected in a detachable manner.

At the time of installation, the first pull rod is first inserted into the first rotating connector to be seized by the first seizing ball, and then the other end is fixedly connected with the first strand cylinder, and the fixed connection can be welding or detachable fixed connection with screw fit. The installation of the second pull rod is the same.

The beneficial effects of the present invention are as follows: a layer of wires are preliminarily stranded by a layer of strand through holes, and the first strand cylinder is used for the second pressing and stranding, so that the structure is more compact. The next layer of special-shaped single wires are stranded through the second pre-stranding assembly, and then the last layer of wires are stranded through the main stranding mold, thus realizing the stranding of a plurality of layers at the same time and compact structure. The outer circumference of the guide roller is redesigned to match with that of the special-shaped single wire, which avoids the reduced quality of stranded cable cores due to the deformation of the special-shaped single wire as caused by stress concentration during guide. The key point of the present invention is the design of the rotating connector, in particular to that the first rotating connector is bowl-shaped and is provided with a layer of strand through holes together with a structure in which the first pull rod is in fit with the rotating connector and a structure in which the second pull rod is in fit with the rotating connector.

DESCRIPTION OF THE PREFERRED EMBODIMENT

The preferred embodiment of the present invention will be described in detail with reference to the accompanying drawings, so that the advantages and features of the present invention will be more readily understood by those skilled in the art, thereby clearly defining the protection scope of the present invention.

Figure 1:
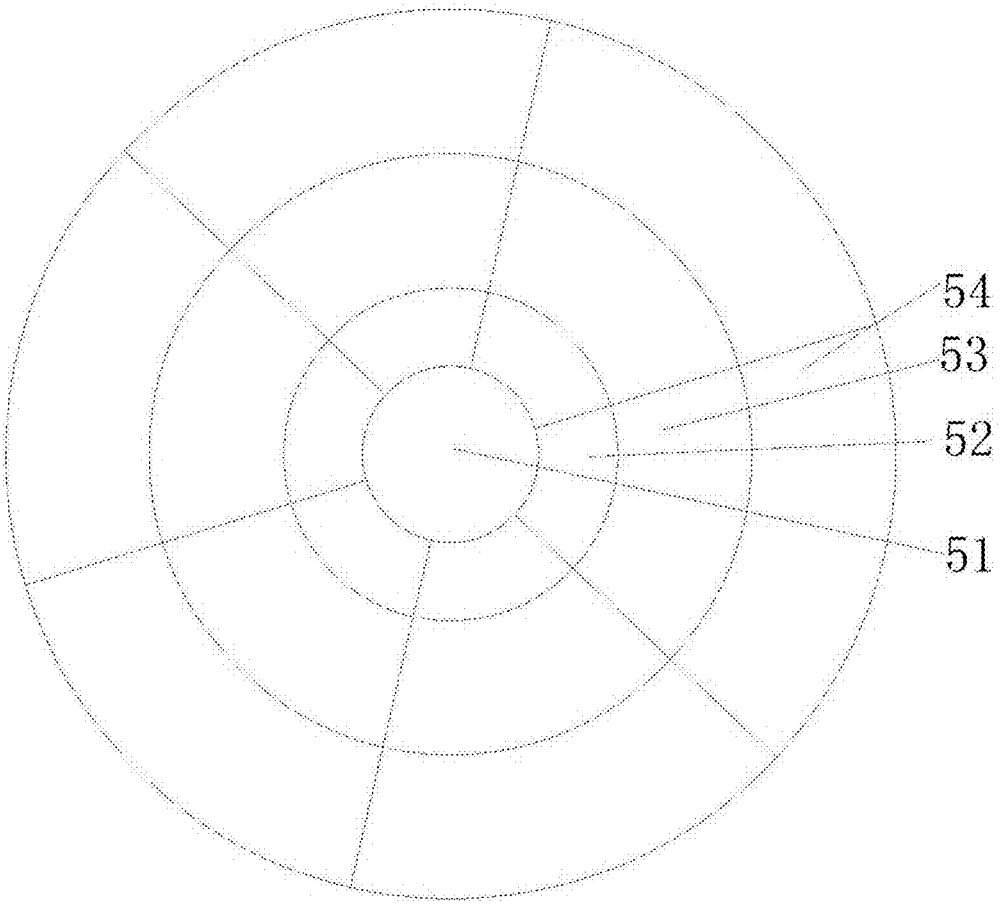
FIG. 1 is a structural diagram of a special-shaped wire according to the present invention.

As shown in FIG. 1, a special-shaped cable wire comprises a support conductor 51, a first strand layer 52, a second strand layer 53 and a third strand layer 54 from the inside to the outside. The support conductor 51 has a circular cross-section, the number of the support conductor 51 can be one or more. The first strand layer 52, second strand layer 53 and third strand layer 54 are formed by stranding single wires with fan-shaped cross sections. However, the shape is not limited to fan shape, and it can be z-type, s-type, triangular or other special-shaped shapes.

As shown in FIG. 2 to FIG. 6, a special-shaped cable core forming mechanism, comprises a guide assembly 1, a first pre-stranding assembly 2 and a main stranding mold 3 which are arranged successively at a same horizontal axis;

the first pre-stranding assembly 2 comprises a first tapered support 21, a first rotating connector 22, a first pull rod 23 and a first strand cylinder 24; the horizontal axis passes through the first tapered support 21, the first rotating connector 22 and the first strand cylinder 24 successively, and the first pull rod 23 is connected with the first rotating connector 22 and the first strand cylinder 24;

the first tapered support 21 is hollow and has two communicated end faces, and a large-diameter end of the first tapered support 21 is fixed to the guide assembly 1;

the first rotating connector 22 is bowl-shaped, and a bowl end of the first rotating connector 22 is fixedly connected with a small-diameter end of the first tapered support 21 by screw fit; at the time of installation, the first pull rod 23 is first inserted into the first rotating connector 22 to be seized by the first seizing ball 231, and then the other end is fixedly connected with the first strand cylinder 24, and the fixed connection can be welding or detachable fixed connection with screw fit, a stranded through hole layer 221 is provided at the center of a bowl bottom of the first rotating connector 22, and the stranded through hole layer 221 is collinear with the horizontal axis; a first annular groove 222 is arranged at an inner side of the bowl bottom of the first rotating connector 22; a first annular hollow 223 is arranged at the bowl bottom of the first rotating connector 22, and the first annular hollow 223 corresponds to the first annular groove 222;

a first seizing ball 231 is arranged on one end of the first pull rod 23, and the first seizing ball 231 and the first annular groove 222 are in sliding fit; one end, on which the first seizing ball 231 is arranged, of the first pull rod 23 movably passes through the first annular hollow 223, and the other end of the first pull rod 23 is fixedly connected with the first strand cylinder 24.

The present utility model is realized as follows: a special-shaped single wire passes through the guide assembly 1 and is guided by the guide assembly 1 into the first pre-stranding assembly 2 for preliminary stranding, and then passes through the main stranding mold 3 for stranding on the last layer and the final tightening of the whole cross section. When the special-shaped single wire passes through the guide assembly 1, the special-shaped single wire passes through the first tampered support 21 along the horizontal axis, then passes through the stranded through hole layer 221 and the first strand cylinder 24; and then the first tapered support 21 rotates with the guide assembly 1, and the rotating connector rotates also. However, the first strand cylinder 24 does not rotate due to the structure of the first annular hollow 223. When the special-shaped single wire passes through the stranded through hole layer 221, the wire is preliminarily stranded on the support conductor 51. When the special-shaped single wire passes through the first strand cylinder 24, the wire is further tightened and stranded. The special-shaped single wire is stranded on the support conductor 51 to form a layer of stranded cable cores. Two stranding steps increase the tightness of the stranded cable cores.

Figure 2:
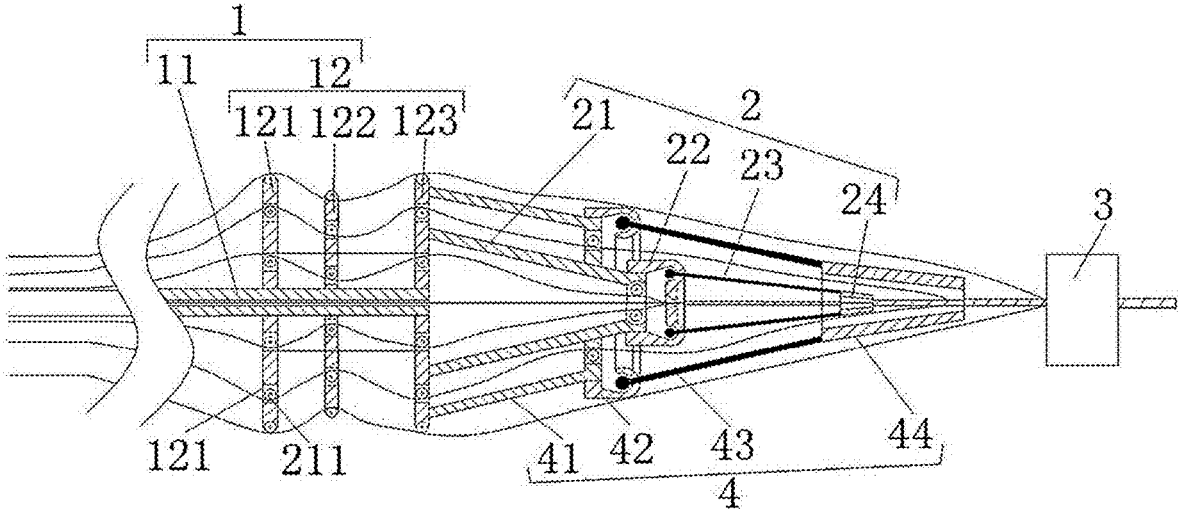
FIG. 2 is a structural diagram of the present invention.
Figure 5B:
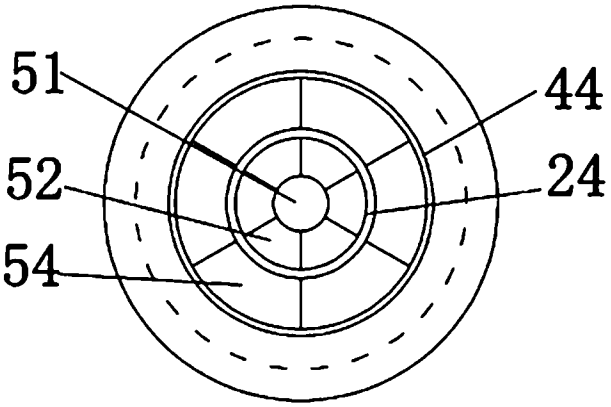
FIG. 5B is a combined cross-sectional structural diagram of the first strand cylinder 24 and the second strand cylinder 44 illustrated in FIG. 5A.
Figure 5A:
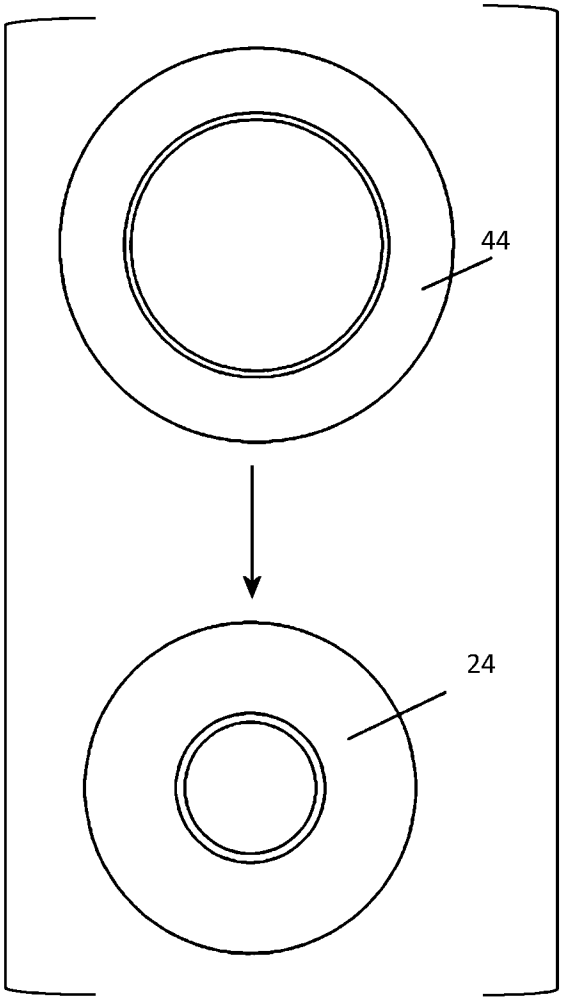
FIG. 5A is exploded cross-sectional structural diagrams of a first strand cylinder 24 and a second strand cylinder 44.

As shown in FIG. 2, the special-shaped cable core forming mechanism also comprises a second pre-stranding assembly 4, wherein the second pre-stranded assembly 4 comprises a second tapered support 41, a second rotating connector 42, a second pull rod 43 and a second strand 44; the horizontal axis passes through the second tapered support 41, the second rotating connector 42 and the second strand 44, and the second pull rod 43 is connected with the second rotating connector 42 and the second strand cylinder 44;

As shown in FIG. 2 and FIG. 5, an inner hole of the first strand cylinder 24 is tapered, a large-diameter end of the inner hole of the first strand cylinder 24 is an incoming end, and a small-diameter end of the inner hole of the first strand cylinder 24 is an outgoing end.

As shown in FIG. 2 and FIG. 5, an inner hole of the second strand cylinder 44 is tapered, a large-diameter end of the inner hole of the second strand cylinder 44 is an incoming end, and a small-diameter end of the inner hole of the second strand cylinder 44 is an outgoing end.

The tapered hole enables the stranded special-shaped single wire to be extruded gradually.

As shown in FIG. 2, the second tapered support 41 is hollow and has two communicated end faces, and a large-diameter end of the second tapered support 41 is fixed to the guide assembly 1 by screw fit; the second tapered support 41 is sheathed on the first tapered support 21, and there is a gap between the first tapered support 21 and the second tapered support 41.

Figure 4B:
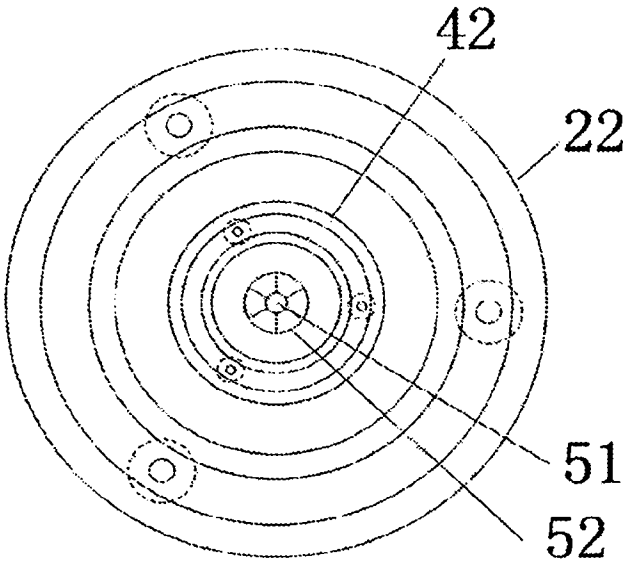
FIG. 4B is a combined cross-sectional structural diagram of the first rotating connector 22 and the second rotating connector 42 illustrated in FIG. 4A.
Figure 4A:
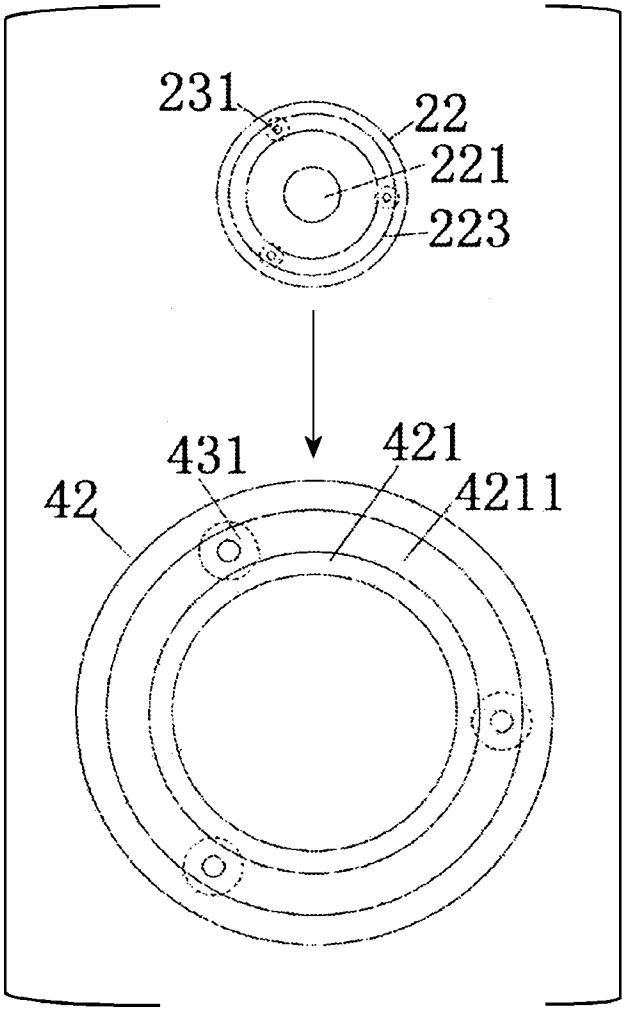
FIG. 4A is exploded cross-sectional structural diagrams of a first rotating connector 22 and a second rotating connector 42.
Figure 6:
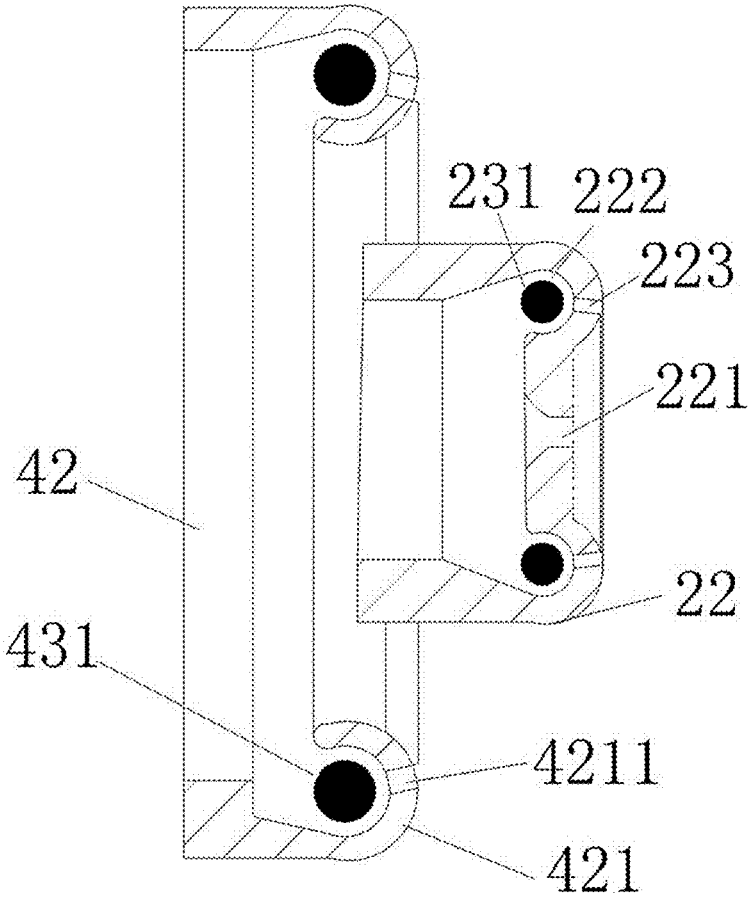
FIG. 6 is a section view of a first rotating connector 22 and a second rotating connector 42.

As shown in FIG. 2, FIG. 4 and FIG. 6, the second rotating connector 42 is tubular, and has two communicated end faces; one end of the second rotating connector 42 is fixedly connected with a small-diameter end of the second tapered support 41, and the other end of the second rotating connector 42 is provided with a curl part 421; the curl part 421 is collinear with the second rotating connector 42, and a second annular hollow 4211 is arranged on the curl part 421;

a second seizing ball 431 wrapped by the curl part 421 is arranged on one end of the second pull rod 43, and the second seizing ball 431 and the curl part 421 are in sliding fit; one end, on which the second seizing ball 431 is arranged, of the second pull rod 43 movably passes through the second annular hollow 4211, and the other end of the second pull rod 43 is fixedly connected with the second strand cylinder 44;

the second strand cylinder 44 is sheathed on the first strand cylinder 24, and there is a gap between the first strand cylinder 24 and the second strand cylinder 44.

A layer of stranded cores pass through a second strand cylinder 44, so that two layers of special-shaped single wires are stranded on a layer of stranded cable cores; the two layers of special-shaped single wires are guided by the guide assembly 1 to pass through the gap between the first tapered support 21 and the second tapered support 41, then pass through the gap between the first strand cylinder 24 and the second strand cylinder 44, and finally enter the second strand cylinder 44 to join with the orderly stranded cable cores, thus forming two layers of stranded cable cores.

Figure 3:
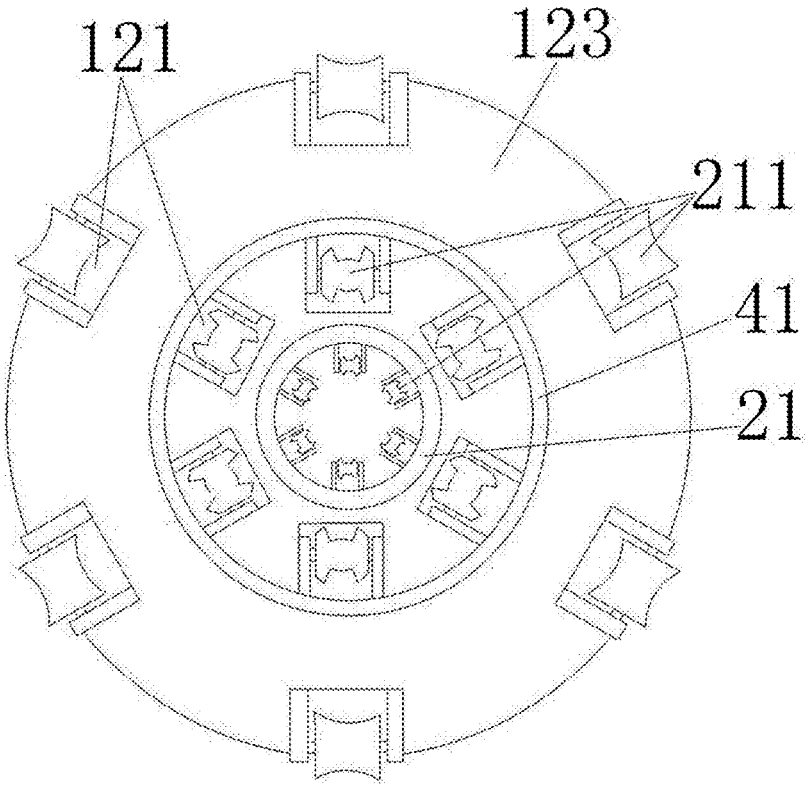
FIG. 3 is a structural diagram of a turntable 12.

As shown in FIG. 2 and FIG. 3, guide rollers 211 are arranged on the small-diameter end of the inner hole of the first tapered support 21, and the number of the guide rollers 211 is consistent with that of single wires on the same strand layer.

As shown in FIG. 2 and FIG. 3, guide rollers 211 are arranged on the small-diameter end of the inner hole of the second tapered support 41, and the number of the guide rollers 211 is consistent with that of single wires on the same strand layer.

The single wire is further guided, thus avoiding the single wire from being scratched.

As shown in FIG. 2, the guide assembly 1 comprises a drum 11 and a turntable 12; both ends of the drum 11 are communicated, and the turntable 12 is fixedly sheathed on the drum 11; both the first tapered support 21 and the second tapered support 41 are fixed to the turntable 12, and receiving through holes 121 are arranged on the turntable 12 in a manner of annular array; the receiving through holes 121 pass through two end faces of the turntable 12; the number of the receiving through holes 121 on the same annular array is consistent with that of the single wires on the same strand layer, and the number of the annular arrays of the receiving through holes 121 is consistent with that of stranded cable core layers;

guide rollers 211 are arranged in the receiving through holes 121 respectively, and an outer circumference of the guide roller 211 matches with an outer circumference of the single wire.

As shown in FIG. 3, when the cross section of the single wire is fan-shaped, for example, the guide roller 211's faces in fit with the fan-shaped single wire are that one face is an outer convex portion and one face is an outer concave portion, which avoids the deformation caused by stress concentration when the fan-shaped single wire is in fit with the guide roller 211.

The drum 11 drives the turntable 12 to rotate synchronously, and each of the single wires passes through the receiving through holes 121, and is guided by the guide roller 211 to rotate with the turntable 12. An outer circumference of the guide roller 211 matches with an outer circumference of the single wire, so that the cross section shape of the special-shaped wire will not deform due to stress concentration when the guide roller 211 guides the special-shaped single wire, thus avoiding the insufficiently tight stranding caused by the deformation during guide.

As shown in FIG. 2, the number of the turntables 12 is three, and the three turntables 12 are strung by the drum 11 into one; the turntable 12 comprise a first turntable 121, a second turntable 122 and a third turntable 123 in order; both the first tapered support 21 and the second tapered support 41 are fixed to the third turntable 123; each of the single wires passes through the first turntable 121, the second turntable 122 and the third turntable 123 in order, and each of the single wires offsets toward the drum 11 at the second turntable 122.

The single wire passes through the first turntable 121, second turntable 122 and third turntable 123 in order.

As shown in FIG. 2, a wire entry of the stranded through hole layer 221 is flared.

The single wire is protected from damage, so that the single wire can be pressed and stranded gradually

What is claimed is:

1. A special-shaped cable core forming mechanism, characterized by comprising a guide assembly, a first pre-stranding assembly and a main stranding mold which are arranged successively at a same horizontal axis;

wherein the first pre-stranding assembly comprises a first tapered support, a first rotating connector, a first pull rod and a first strand cylinder; the horizontal axis passes through the first tapered support, the first rotating connector and the first strand cylinder in order, and the first pull rod is connected with the first rotating connector and the first strand cylinder;

the first tapered support is hollow and has two communicated end faces, and a large-diameter end of the first tapered support is fixed to the guide assembly;

the first rotating connector comprises a front end and a back end, and the front end of the first rotating connector is fixedly connected with a small-diameter end of the first tapered support; a stranded through hole layer is provided at a center of the back end of the first rotating connector, and the stranded through hole layer is collinear with the horizontal axis; a first annular groove is arranged at an inner side of the back end of the first rotating connector; a first annular hollow is arranged at the back end of the first rotating connector, and the first annular hollow corresponds to the first annular groove; and a first seizing ball is arranged on one end of the first pull rod, and the first seizing ball and the first annular groove are in sliding fit; one end, on which the first seizing ball is arranged, of the first pull rod movably passes through the first annular hollow, and the other end of the first pull rod is fixedly connected with the first strand cylinder.

2. The special-shaped cable core forming mechanism according to claim 1, characterized by further comprising a second pre-stranding assembly, wherein the second pre-stranding assembly comprises a second tapered support, a second rotating connector, a second pull rod and a second strand cylinder; the horizontal axis passes through the second tapered support, the second rotating connector and the second strand cylinder successively, and the second pull rod is connected with the second rotating connector and the second strand cylinder;

the second tapered support is hollow and has two communicated end faces, and a large-diameter end of the second tapered support is fixed to the guide assembly; the second tapered support is sheathed on the first tapered support, and there is a gap between the first tapered support and the second tapered support;

the second rotating connector is tubular, and has two communicated end faces; one end of the second rotating connector is fixedly connected with a small-diameter end of the second tapered support, and the other end of the second rotating connector is provided with a curl part; the curl part is collinear with the second rotating connector, and a second annular hollow is arranged on the curl part;

a second seizing ball wrapped by the curl part is arranged on one end of the second pull rod, and the second seizing ball and curl part are in sliding fit; one end, on which the second seizing ball is arranged, of the second pull rod movably passes through the second annular hollow, and the other end of the second pull rod is fixedly connected with the second strand cylinder; and the second strand cylinder is sheathed on the first strand cylinder, and there is a gap between the first strand cylinder and the second strand cylinder.

3. The special-shaped cable core forming mechanism according to claim 1, characterized in that an inner hole of the first strand cylinder is tapered, a large-diameter end of the inner hole of the first strand cylinder is an incoming end, and a small-diameter end of the inner hole of the first strand cylinder is an outgoing end.

4. The special-shaped cable core forming mechanism according to claim 2, characterized in that an inner hole of the second strand cylinder is tapered, a large-diameter end of the inner hole of the second strand cylinder is an incoming end, and a small-diameter end of the inner hole of the second strand cylinder is an outgoing end.

5. The special-shaped cable core forming mechanism according to claim 3, characterized in that guide rollers are arranged on the small-diameter end of the inner hole of the first tapered support, and the number of the guide rollers is consistent with that of single wires on a same strand layer.

6. The special-shaped cable core forming mechanism according to claim 4, characterized in that guide rollers are arranged on the small-diameter end of the inner hole of the second tapered support, and the number of the guide rollers is consistent with that of single wires on a same strand layer.

7. The special-shaped cable core forming mechanism according to claim 2, characterized in that the guide assembly comprises a drum and a turntable; both ends of the drum are communicated, and the turntable is fixedly sheathed on the drum; both the first tapered support and the second tapered support are fixed to the turntable, and receiving through holes are arranged on the turntable in a manner of annular array; the receiving through holes pass through two end faces of the turntable; the number of the receiving through holes on the same annular array is consistent with that of the single wires on the same strand layer, and the number of the annular arrays of the receiving through holes is consistent with that of stranded cable core layers; and guide rollers are arranged in the receiving through holes respectively, and an outer circumference of the guide rollers matches with an outer circumference of the single wires.

8. The special-shaped cable core forming mechanism according to claim 7, characterized in that the turntable comprises three turntables, and the three turntables are strung by the drum into one; the three turntable comprise a first turntable, a second turntable and a third turntable in order; both the first tapered support and the second tapered support are fixed to the third turntable; each of the single wires passes through the first turntable, the second turntable, and the third turntable in order, and each of the single wires offsets toward the drum at the second turntable.

9. The special-shaped cable core forming mechanism according to claim 1, characterized in that a wire entry of the stranded through hole layer is flared.

10. The special-shaped cable core forming mechanism according to claim 2, characterized in that the first rotating connector and the first tapered support are fixedly connected in a detachable manner, and the second rotating connector and the second tapered support are fixedly connected in a detachable manner.

* * * * *